US011319699B2

(12) United States Patent
Tzeng

(10) Patent No.: US 11,319,699 B2
(45) Date of Patent: May 3, 2022

(54) INTELLIGENT DRAINAGE DEVICE

(71) Applicant: NCIP INC., Taipei (TW)

(72) Inventor: Rong-Chyan Tzeng, Taipei (TW)

(73) Assignee: NCIP INC., Taipei (TW)

( * ) Notice: Subject to any disclaimer, the term of this patent is extended or adjusted under 35 U.S.C. 154(b) by 258 days.

(21) Appl. No.: 16/844,409

(22) Filed: Apr. 9, 2020

(65) Prior Publication Data

US 2021/0317646 A1 Oct. 14, 2021

(51) Int. Cl.
*E03C 1/242* (2006.01)
*A47K 3/00* (2006.01)
*E03C 1/05* (2006.01)

(52) U.S. Cl.
CPC ..... *E03C 1/242* (2013.01); *A47K 3/001* (2013.01); *E03C 1/055* (2013.01)

(58) Field of Classification Search
CPC ..... E03C 1/244; E03C 1/242; E03C 1/055
USPC ..... 4/650
See application file for complete search history.

(56) References Cited

U.S. PATENT DOCUMENTS

2013/0081727 A1* 4/2013 Sugie ..... F16K 11/0856 137/862

* cited by examiner

*Primary Examiner* — Lauren A Crane
(74) *Attorney, Agent, or Firm* — WPAT, PC

(57) ABSTRACT

An intelligent drainage device includes a power supply unit, a water discharge key, drain assemblies, a motor drive unit and a control unit. The drain assembly, installed to a bathtub drain hole, includes a waterstop member, a stepping motor and a receiving tube. The receiving tube engages fixedly and oppositely the waterstop member and a power transmission shaft of the stepping motor. The control unit receives a start/stop signal from the water discharge key, then transmits the signal to the motor drive unit for controlling the power transmission shaft to drive the corresponding waterstop member to move upward or downward. In this device, with a simple touch at the water discharge key, the control unit would control the motor drive unit to activate the stepping motors so as to have all the drain assemblies at the respective drain holes to discharge simultaneously and rapidly the water inside a bathtub.

7 Claims, 10 Drawing Sheets

INTELLIGENT DRAINAGE DEVICE

TECHNICAL FIELD

The present disclosure relates in general to an intelligent drainage device particularly applied to a bathtub that integrates an electronic control system to drain quickly water inside the bathtub.

BACKGROUND

In view of "aging" population in Taiwan, a "senior society" is unquestionable the current state, similar to Japan which is early already one of the senior societies in the world. The aging population is also increasing in other major countries on this planet such as China and the United states. In caring or nursing the seniors, bathing is one of many important tasks that require extremely cautions and patience. Bathing can refresh the skin, relieve the fatigue and also improve sleep quality. Especially in the summer time, notorious temperature and moisture have made the bathing as the most important way to kill the summer discomfort. Nevertheless, to those seniors unable to keep their own bodies sound, taking a bath is not an easy job. Actually, in many regards, carelessness or improper handling in bathing is generally the reason to harm these aging people. Especially, while bathing in a bathtub, decrease in bath temperature is quite possible to cause rapid drop in body temperature of the aging people. Thereupon, disease infection and reduced immunity would be inevitable.

In the current marketplace, a bathtub equipped with a plurality of doors/windows is particularly suitable for the seniors, especially for disable patients or aging people. After finishing a bath in this bathtub, the bath water is firstly drained, then the body is wiped off, and a bath towel is used to cover the body before opening the door to exit the bathtub, by his/herself or with a help from a nursing worker. However, if excessive time is spent in draining the bath water, the temperature of the residual water inside the bathtub would drop quickly, and thus too low to keep warm the naked patient or senior still in the bathtub. Hence, possibility in getting cold would be high. Even in a traditional bathtub or in a bathtub without doors/windows if the drainage takes too long, the wiping off would be further delayed. In addition, the bath towel to wrap the naked patient or senior wrapped with a bath towel is also vulnerable to the cold.

In the art, a conventional bathtub plug connected with a slender chain is generally used to seal a drain hole of the bathtub. By pulling the plug off the drain hole through the chain, the bath water can be discharged. In the case that the chain is damaged, or the plug is too tight with the drain hole, then the plug-pulling shall be performed by directly hand reaching the plug which is usually located at a position right under the naked body of the patient or the aging people. Definitely, such a movement would cause inconvenience and embarrassment in between.

SUMMARY

An object of the present disclosure is to provide an intelligent drainage device, which applies an electronic control system to drain synchronously and rapidly water inside a bathtub through a plurality of drain assemblies.

In this disclosure, the intelligent drainage device includes a power supply unit, a water discharge key, at least one drain assembly, a motor drive unit and a control unit. The power supply unit is used for introducing a DC power to energize the intelligent drainage device. The water discharge key is used for issuing a signal for starting or stopping water drainage. The at least one drain assembly, installed to at least one drain hole of a bathtub, includes a waterstop member, a stepping motor and a receiving tube. The waterstop member further includes a waterstop cover and a guide bar. The waterstop cover is used for sealing the drain hole of the bathtub. A top end of the guide bar is connected with a bottom of the waterstop cover as a unique piece. The stepping motor has a power transmission shaft. A lower end of the guide bar of the waterstop member pierces into an upper end of the receiving tube in a tight match manner. The power transmission shaft of the stepping motor, plugged into and thus connected with a lower portion of the receiving tube, is used for driving the receiving tube and the waterstop member to descend or ascend. The motor drive unit is used for simultaneously driving each of the at least one stepping motor to rotate by a corresponding rotational angle either clockwise or counter clockwise or by a 0-degree angle for calibration. The control unit is used for receiving the signal for starting or stopping water drainage issued by the water discharge key, transmitting the signal to the motor drive unit for driving the stepping motor of each of the at least one drain assembly, and controlling the power transmission shaft of the stepping motor to drive the corresponding waterstop member to move upward or downward.

In one embodiment of this disclosure, the drain assembly further includes a water guide assembly disposed under a drain hole of the bathtub and also connected spatially with the drain hole, and the water guide assembly is furnished with at least one drain aperture.

In one embodiment of this disclosure, the receiving tube penetrates through the through hole at a bottom portion of the water guide assembly so as not to correctly guide a lifting trajectory of the receiving tube.

In one embodiment of this disclosure, the receiving tube is a circular tube, the transmission shaft of the stepping motor is connected with the receiving tube is in a tight match manner, the power transmission shaft performs a telescopic action when the stepping motor is activated.

In one embodiment of this disclosure, the receiving tube is non-circular shaped, the through hole at a bottom of the water guide assembly is also non-circular shaped, the power transmission shaft of the stepping motor is a rotational screw bar, the receiving tube has a central screw hole, the power transmission shaft is screwed into the screw hole of the receiving tube, and the power transmission shaft is rotated when the stepping motor is activated.

In one embodiment of this disclosure, the water guide assembly is furnished with a single drain aperture formed as a pipe hole shape for connecting the drain hose.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
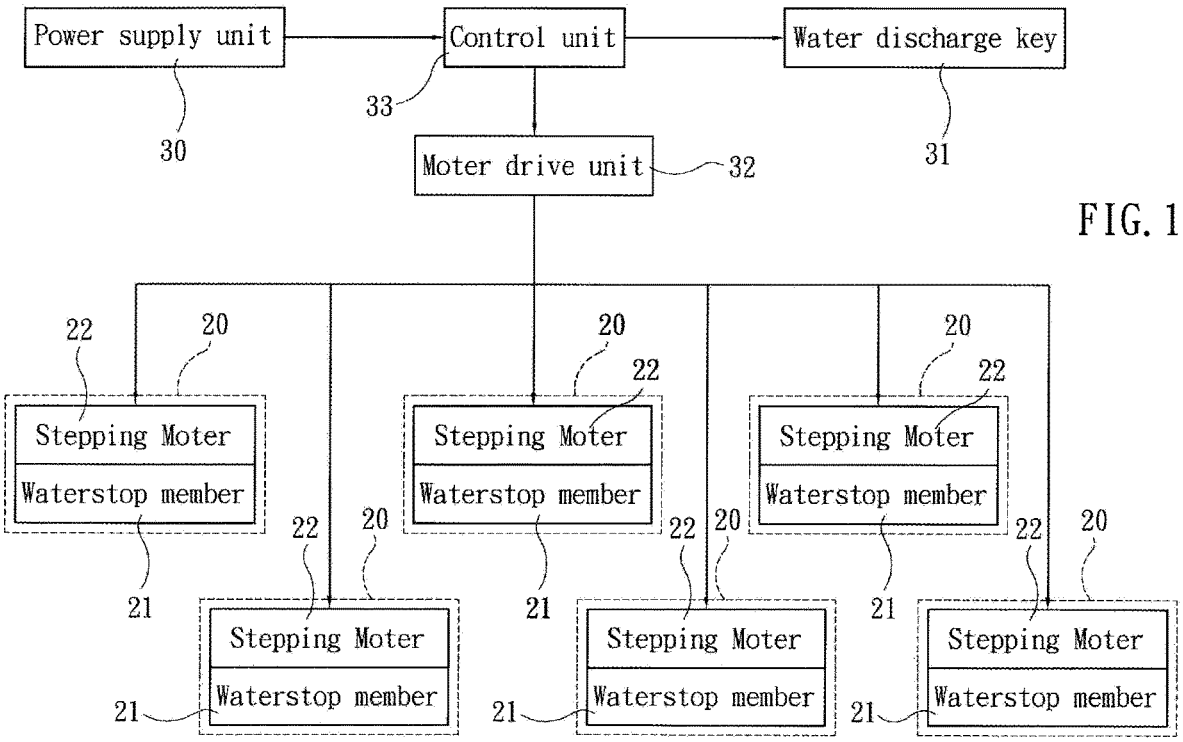
FIG. 1 is a schematic block view of an embodiment of the intelligent drainage device in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
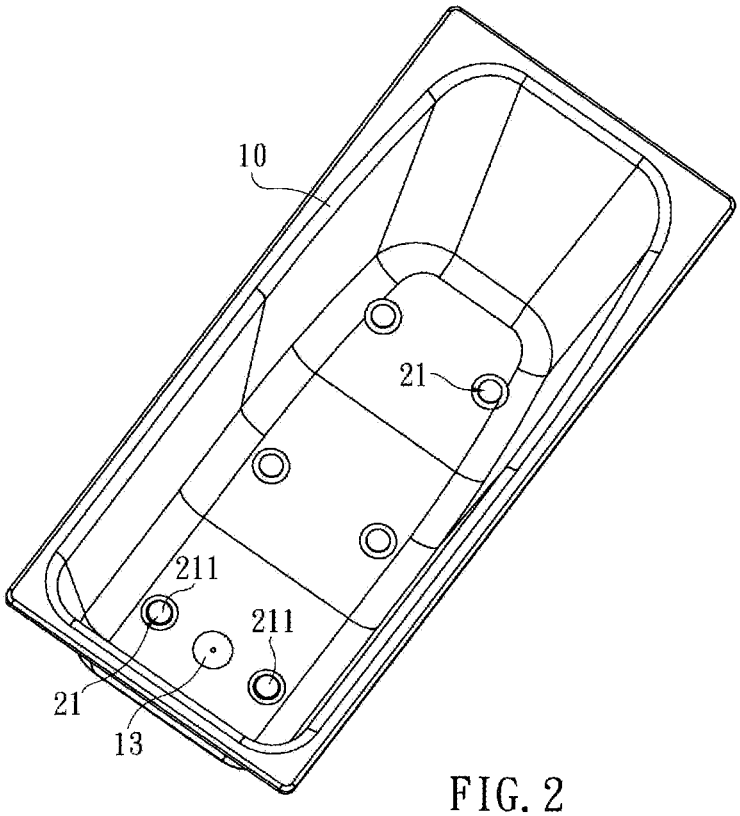
FIG. 2 is a schematic perspective view of a bathtub to be equipped with the intelligent drainage device in accordance with this disclosure.
Figure 3:
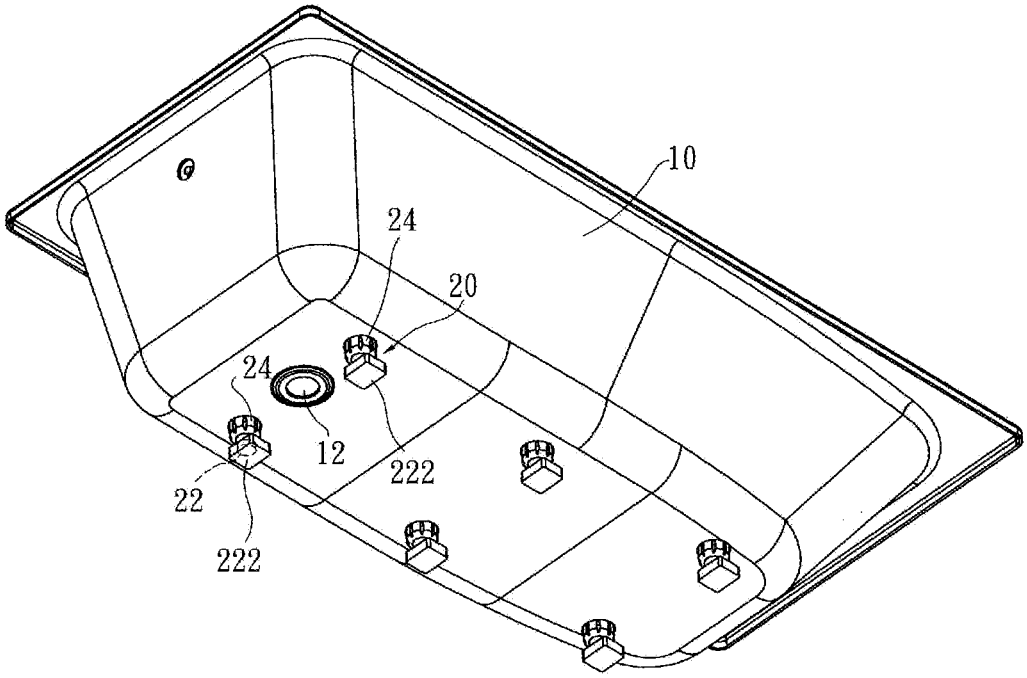
FIG. 3 is another view of the bathtub of FIG. 2, already equipped with the intelligent drainage device in accordance with this disclosure.

Referring to FIG. 1~FIG. 3, an embodiment of the intelligent drainage device is mainly to apply an electronic control system to simultaneously activate all drain assemblies 20 at corresponding drain holes 11 of a bathtub 10 (see FIG. 5) for initiating or stopping synchronously water discharge. The intelligent drainage device includes thereof a power supply unit 30, a water discharge key 31, at least one set of the drain assembly 20, a motor drive unit 32, and a control unit 33. While the device is on, the water discharge key 31 is depressed so as to have all the drain assemblies 20 at the respective drain holes 11 to be simultaneously activated so as to rapidly discharge the water inside the bathtub. In particular, the bathtub can still keep a conventional drain hole 12 to be tightened by a conventional plug.

The power supply unit 30 is mainly to introduce a DC power for energizing the device. In this disclosure, the power supply unit 30 can be a DC power supply connected electrically with s household power and used for transforming an AC power into the DC power for the device.

The water discharge key 31 can be a push-button switch control. By depressing the water discharge key 31, a corresponding signal for starting or stopping water drainage can be issued.

Figure 4:
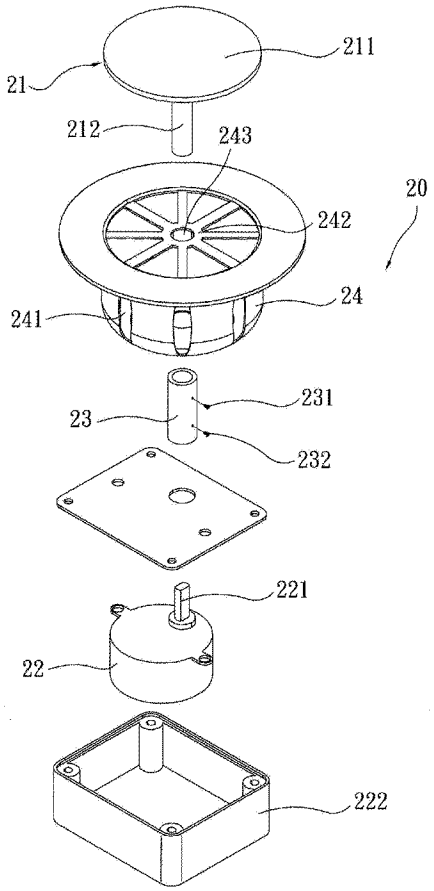
FIG. 4 is a schematic exploded view of a drain assembly for the intelligent drainage device in accordance with this disclosure.

Each drain assemblies 20 is installed to one corresponding drain hole 11 furnished to the bathtub 10. Namely, each of the plurality of drain holes 11 is furnished with one drain assembly 20. Referring to FIG. 4, the drain assembly 20 includes a waterstop member 21, a stepping motor 22 and a receiving tube 23. The waterstop member 21 includes a disc-shape waterstop cover 211 and a guide bar 212. A top end of the guide bar 212 is connected perpendicularly with a bottom of the waterstop cover 211 so as to make the waterstop member 21 as a unique piece. Preferably, the guide bar 212 is connected to a center of the waterstop cover 211. The waterstop cover 211 can seal the corresponding drain hole 11, by having a lower end of the guide bar 211 to pierce into an upper end of the receiving tube 23 in a tight match manner Practically, a plurality of screws 231 is radially furnished to the receiving tube 23. By tightening the screws 231 properly and radially, a lower portion of the guide bar 212 sleeved by the receiving tube 23 can be positioned fixedly inside the receiving tube 23.

The stepping motor 22 has a power transmission shaft 22 for plugging into and thus connecting a lower portion of the receiving tube 23. The power transmission shaft 221 of the stepping motor 22 is to lift up and down the waterstop member 21. In this embodiment, while the stepping motor 22 is on, the power transmission shaft 21 can perform a telescopic action for driving the waterstop member 21 to descend or ascend. Practically, a plurality of screws 232 is radially furnished to the receiving tube 23. By tightening the screws 232 properly and radially, an upper portion of the power transmission shaft 221 sleeved by the receiving tube 23 can be positioned fixedly inside the receiving tube 23. Empirically, the stepping motor 22 is protected by a waterproof box casing 222.

The motor drive unit 32 is to drive each of the plurality of stepping motors 22 to rotate by corresponding rotational angles, clockwise or counter clockwise, or by a 0-degree angle for calibration.

Figure 5:
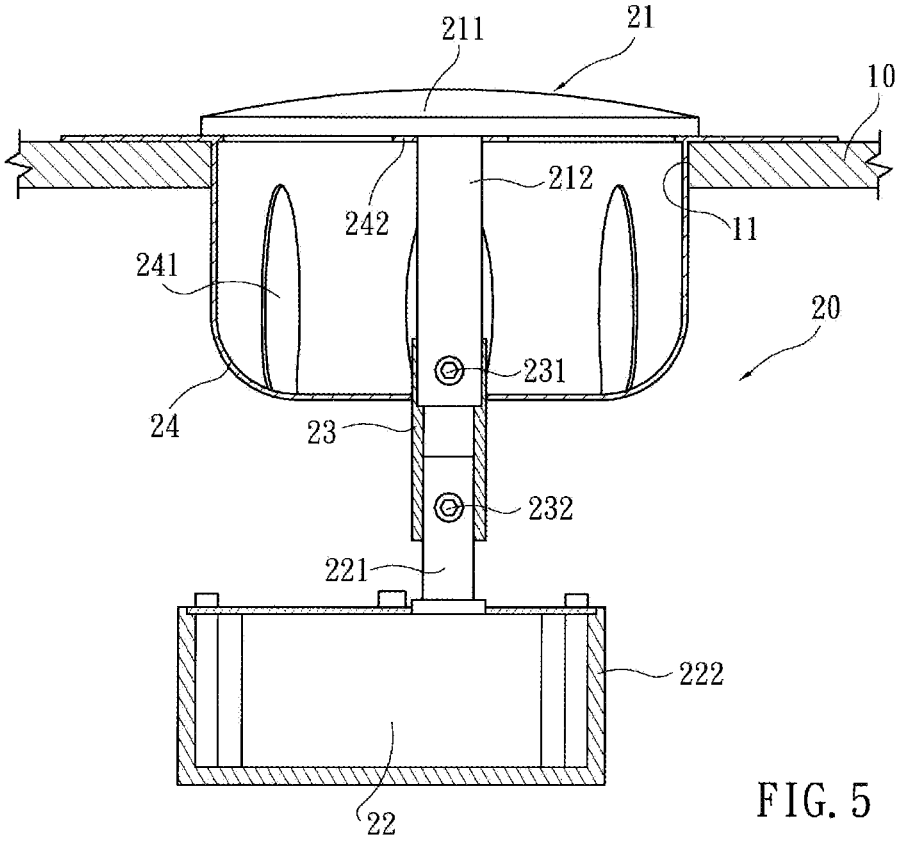
FIG. 5 is a schematic cross-sectional view of the drain assembly of FIG. 4.
Figure 6:
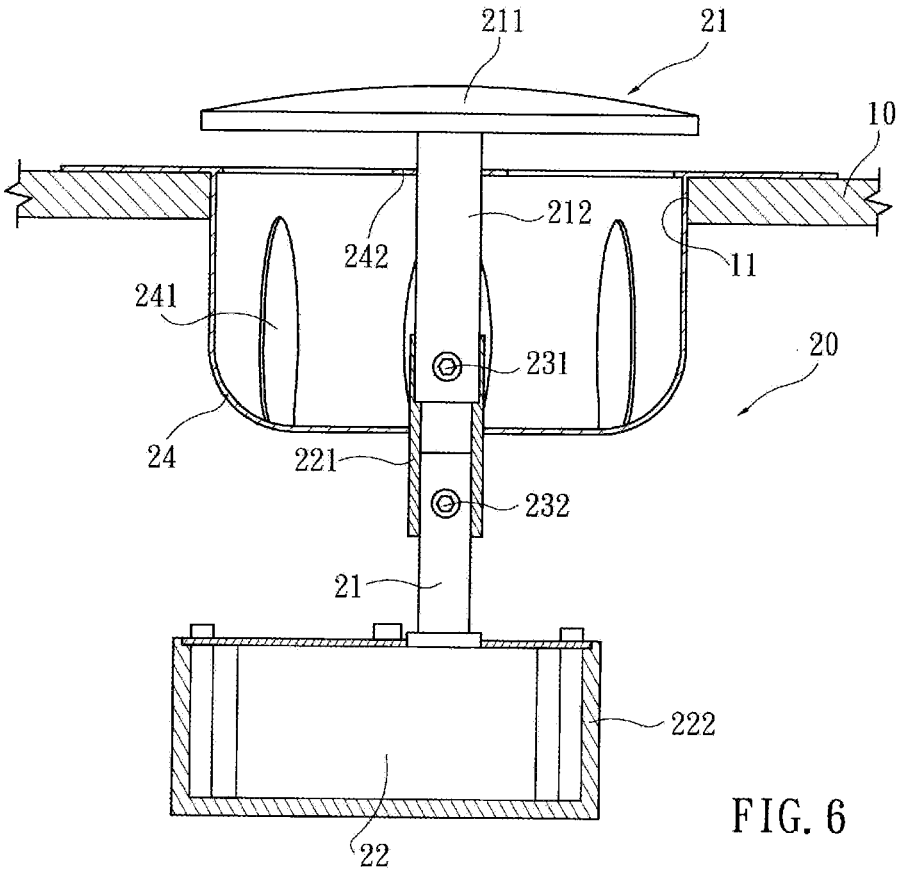
FIG. 6 demonstrates schematically a drain state of the drain assembly of FIG. 5.

The control unit 33 can evaluate the signal for starting or stopping water drainage issued by the water discharge key 31 so as to control the motor drive unit 32 to rotate simultaneously the corresponding stepping motor 22 of each of the drain assemblies 20. Thereupon, the power transmission shaft 221 of each of the plurality of stepping motors 22 can synchronously drive all the waterstop members 21 upward or downward. In the case that the waterstop member 21 is lifted up, a corresponding drain state can be obtained, as shown in FIG. 6. On the other hand, in the case that the waterstop member 21 is lifted down, a corresponding waterstop state can be obtained, as shown in FIG. 5.

In order to protect a weaken senior or patient from a body-temperature drop or a cold, a shower bath is usually irrelevant thereto. However, in a bathtub bath, the body temperature can be kept since the body can be dipped into the warm water, and so a cold can be avoided. Beside the conventional manual waterstop plug 13 originally furnished to the bathtub, a plurality of drain holes 11 and a plurality of corresponding drain assemblies 20 can be furnished thereto. In this embodiment, six drain holes 11 and six drain assemblies 20 are included. After a senior finishes his/her bathtub bath, the instant device can be activated to lift up synchronously all the waterstop members 20 of the six corresponding drain assemblies 20, such that the bath water can be quickly drained out of the bathtub. Thus, the waiting time for a wipe-off after the bathing is finished can be significantly reduced.

The aforesaid drain assembly 20 can further include a water guide assemblies 24. This water guide assembly 24 is disposed under the drain hole 11 of the bathtub 10 to connected spatially with the drain hole 11. In this embodiment, the water guide assembly 24 is inserted into the drain hole 11 to form a water discharge path. The water guide assembly 24 is furnished with at least one drain aperture 241. In the case that the waterstop member 21 of the drain assembly 20 is lifted up to reach the drain state, the bath water inside the bathtub 11 would flow into the water guide assembly 24, and then would be discharged via each of the at least one drain aperture 241 into the drain hole 11. The receiving tube 23 is to penetrate through the water guide assembly 24 so as able not to have its own lifting trajectory affected. Practically, the water guide assembly 24 is furnished on top thereof with a stop plate 242 having a plurality of through holes. The stop plate 242 is furnished with a center hole 243 for allowing the guide bar 212 of the waterstop member 21 to penetrate therethrough, and thus the lifting trajectory of the guide bar 212 can be kept centrally.

Figure 7:
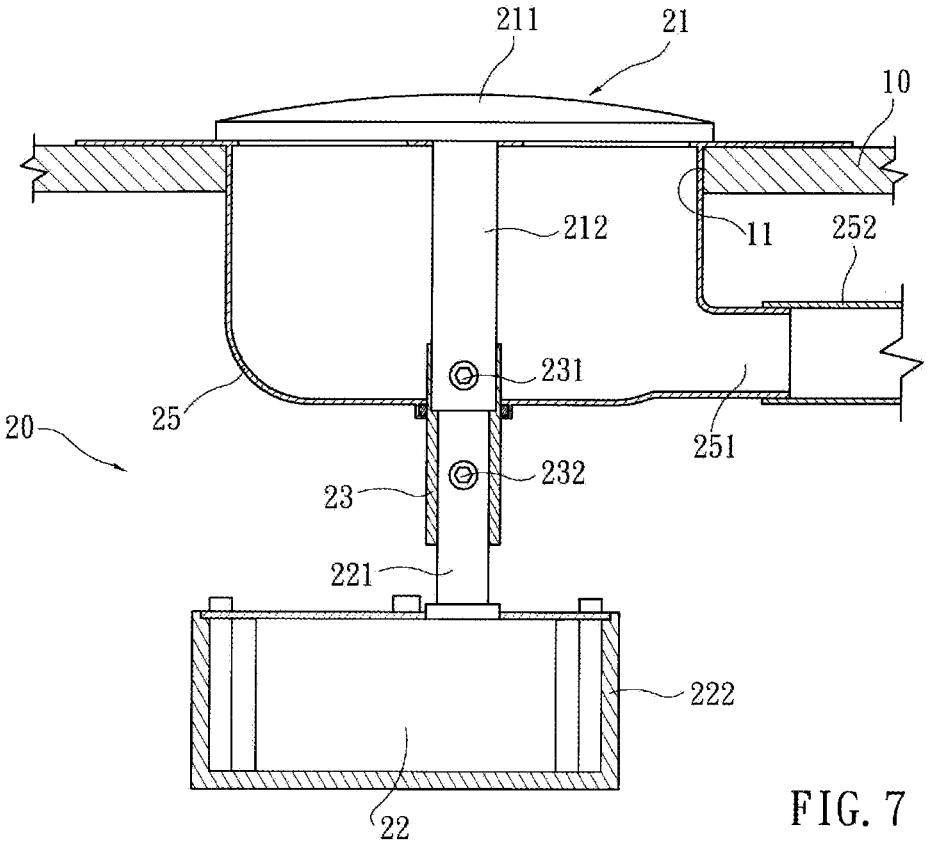
FIG. 7 is a schematic cross-sectional view of another embodiment of the water guide assembly in accordance with this disclosure.

FIG. 7 shows another embodiment of the water guide assembly in accordance with this disclosure. In this embodiment, the water guide assembly 25 is furnished with a single drain aperture 251 in a pipe hole manner for connecting the drain hose 252, so that the bath water inside the bathtub can be discharged to the predetermined pipe or or to a specific position.

Figure 8:
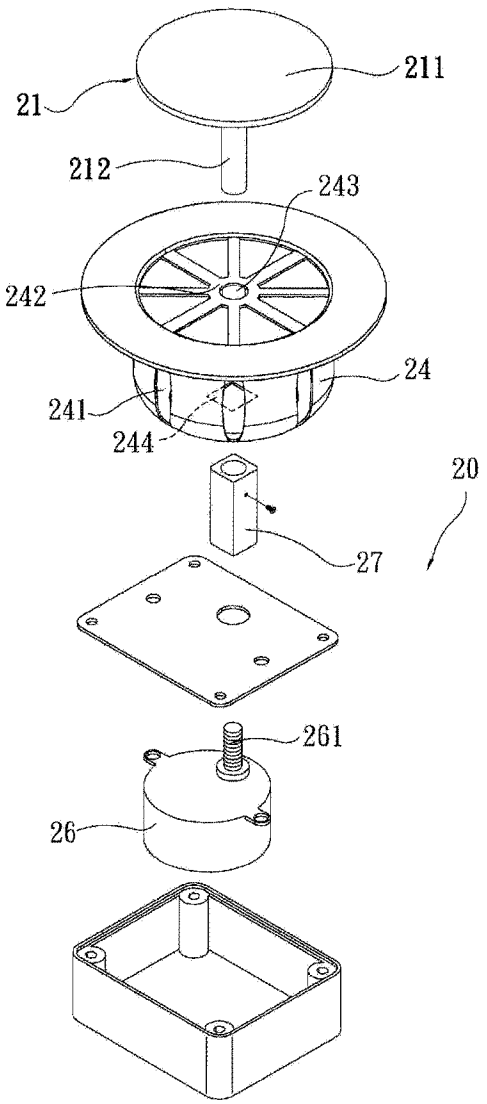
FIG. 8 is a schematic cross-sectional view of another embodiment of the drain assembly in accordance with this disclosure.
Figure 9:
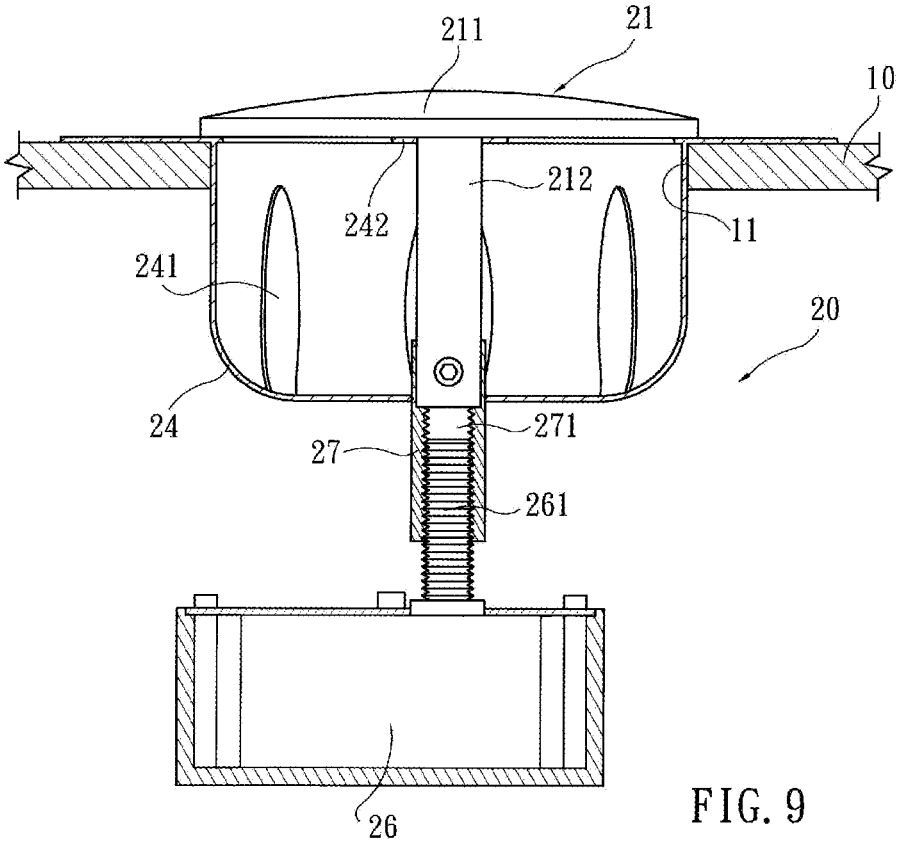
FIG. 9 is a schematic cross-sectional view of the drain assembly of FIG. 8.
Figure 10:
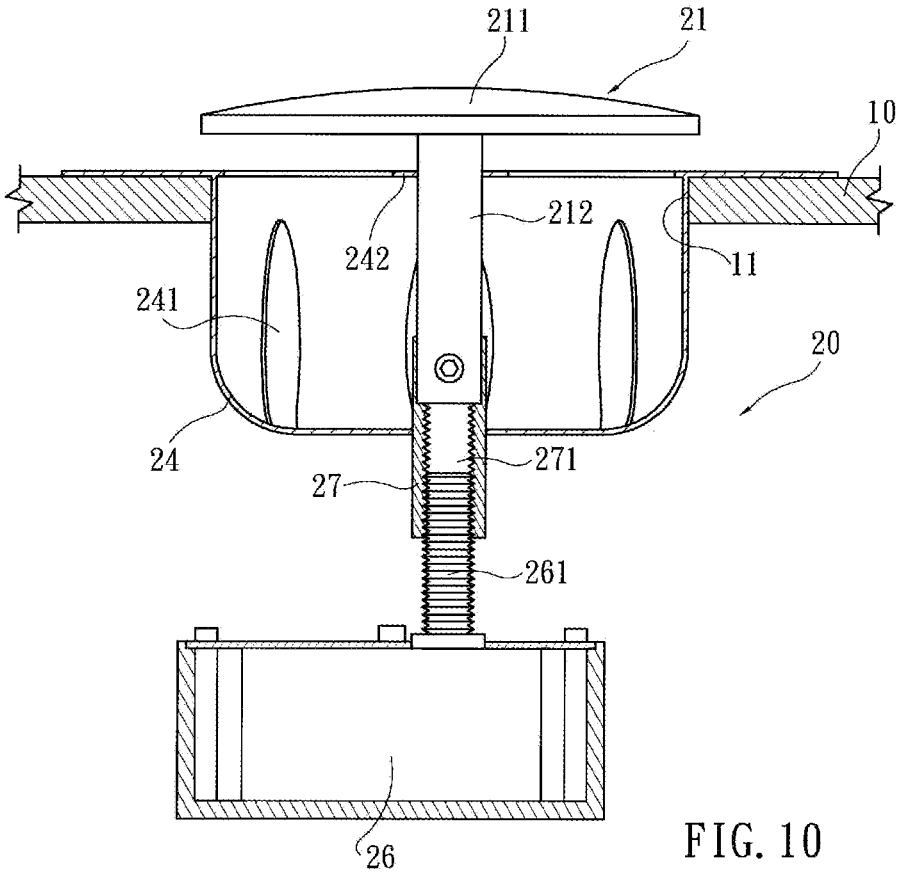
FIG. 10 demonstrates schematically a drain state of the drain assembly of FIG. 9.

In the current marketplace, the movement of the power transmission shaft of the stepping motor is a telescopic style or a rotational style. In the embodiment shown in FIG. 8, the power transmission shaft 261 of the stepping motor 26 is a rotational style. As shown, the appearance of the receiving tube 27 is not a circular pipe but a square pipe having a through screw hole 271. The through hole 244 at a bottom of the water guide assembly 24 is shaped to be a corresponding square hole. The power transmission shaft 261 of the stepping motor 26 is shaped as a screw bar to be screwed into the screw hole 271 of the receiving tube 27. While the stepping motor 26 is on, the power transmission shaft 261 can rotate so as to produce an up-and-down motion for driving the receiving tube 27, as shown in FIG. 9 and FIG. 10.

In summary, the intelligent drainage device provided by this disclosure furnishes the bathtub 10 with a plurality of drain holes 11 and corresponding drain assemblies 20. In addition, the electronic control system is applied to synchronously control all the drain assemblies 20 for discharging the bath water. Thereupon, the drain rate of the bathtub can be greatly improved.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. An intelligent drainage device, comprising:

a power supply unit, used for introducing a DC power to energize the intelligent drainage device;

a water discharge key, used for issuing a signal for starting or stopping water drainage;

at least one drain assembly, installed to at least one drain hole of a bathtub, including a waterstop member, a stepping motor and a receiving tube, the waterstop member further including a waterstop cover and a guide bar, the waterstop cover being used for sealing the drain hole of the bathtub, a top end of the guide bar being connected with a bottom of the waterstop cover as a unique piece, the stepping motor having a power transmission shaft, a lower end of the guide bar of the waterstop member piercing into an upper end of the receiving tube in a tight match manner, the power transmission shaft of the stepping motor being plugged into and thus connected with a lower portion of the receiving tube, the power transmission shaft of the stepping motor being used for driving the receiving tube and the waterstop member to descend or ascend;

a motor drive unit, used for simultaneously driving each of the at least one stepping motor to rotate by a corresponding rotational angle either clockwise or counter clockwise or by a 0-degree angle for calibration; and a control unit, used for receiving the signal for starting or stopping water drainage issued by the water discharge key, transmitting the signal to the motor drive unit for driving the stepping motor of each of the at least one drain assembly, and controlling the power transmission shaft of the stepping motor to drive the corresponding waterstop member to move upward or downward.

2. The intelligent drainage device of claim 1, wherein the drain assembly further includes a water guide assembly disposed under a drain hole of the bathtub and also connected spatially with the drain hole, and the water guide assembly is furnished with at least one drain aperture.

3. The intelligent drainage device of claim 2, wherein the receiving tube penetrates through the through hole at a bottom portion of the water guide assembly so as to correctly guide a lifting trajectory of the receiving tube.

4. The intelligent drainage device of claim 3, wherein the receiving tube is a circular tube, the transmission shaft of the stepping motor is connected with the receiving tube is in a tight match manner, the power transmission shaft performs a telescopic action when the stepping motor is activated.

5. The intelligent drainage device of claim 4, wherein the receiving tube is furnished with a plurality of radial screws for positioning fixedly the power shaft of the stepping motor to the receiving tube and the power transmission shaft.

6. The intelligent drainage device of claim 3, wherein the receiving tube is non-circular shaped, the through hole at a bottom of the water guide assembly is also non-circular shaped, the power transmission shaft of the stepping motor is a rotational screw bar, the receiving tube has a central screw hole, the power transmission shaft is screwed into the screw hole of the receiving tube, and the power transmission shaft is rotated when the stepping motor is activated.

7. The intelligent drainage device of claim 2, wherein the water guide assembly is furnished with a single drain aperture formed as a pipe hole shape.

* * * * *